United States Patent [19]

Scheiwiller

[11] Patent Number: 4,524,551

[45] Date of Patent: Jun. 25, 1985

[54] CONSTRUCTION UNITS FOR THE ERECTION OF WALLS AND METHOD OF UTILIZATION

[76] Inventor: Rolf Scheiwiller, Beichelacker, 3115 Gerzensee, Switzerland

[21] Appl. No.: 356,909

[22] Filed: Mar. 8, 1982

[30] Foreign Application Priority Data

Mar. 10, 1981 [EP] European Pat. Off. ..... 81810089.3

[51] Int. Cl.[3] ..... E04C 1/10

[52] U.S. Cl. ..... 52/98; 52/593; 52/608; 52/605; 52/125.3; 47/83; 405/286

[58] Field of Search ..... 52/98, 100, 593, 594, 52/608, 607, 605, 125.3; 47/82, 83; 405/284, 405/285, 286, 287

[56] References Cited

U.S. PATENT DOCUMENTS

| | | | |
|---|---|---|---|
| 2,301,672 | 11/1942 | Akam | 52/125.3 |
| 2,387,659 | 10/1945 | Hafsos | 52/593 |
| 3,354,592 | 11/1967 | Curci | 52/98 |
| 3,376,682 | 4/1968 | Briscoe | 52/436 |
| 3,534,518 | 10/1970 | Zagray | 52/437 |
| 3,726,042 | 4/1973 | Haile | 47/83 |
| 4,190,384 | 2/1980 | Neumann | 52/609 |

FOREIGN PATENT DOCUMENTS

| | | | |
|---|---|---|---|
| 0016353 | 2/1980 | European Pat. Off. . | |
| 816452 | 10/1951 | Fed. Rep. of Germany . | |
| 6752423 | 2/1969 | Fed. Rep. of Germany . | |
| 2701673 | 7/1978 | Fed. Rep. of Germany . | |
| 598990 | 12/1925 | France | 52/593 |
| 2421243 | 10/1979 | France . | |
| 608703 | 9/1960 | Italy | 52/593 |
| 78724 | 6/1980 | Japan | 405/284 |
| 908901 | 10/1962 | United Kingdom . | |
| 1386088 | 3/1975 | United Kingdom | 52/593 |
| 2087701 | 6/1982 | United Kingdom | 47/83 |

*Primary Examiner*—Henry E. Raduazo

*Attorney, Agent, or Firm*—Wender Murase & White

[57] ABSTRACT

The set of construction units comprises a standard stone, a long stone and a trough stone having a substantially trapezoidal end view, a surrounding groove at the side with the broader base line, on both sides of the surrounding groove a longitudinal slot and at the side with the smaller base line, opposite to each of the longitudinal slots a longitudinal rib. The long stone has dimensions approximately twice as high and about three times as long as the standard stone. Both the standard and long stones have in the surrounding groove a surrounding bead, permitting the stones to be split in half. They also have five holes for making the stones lighter and for permitting these stones to be connected together with reinforced concrete so that they can be utilized as lintels. The trough stone is also twice as high and about three times as long as the standard stone. The closure stone comprises a surrounding bead as well as longitudinal slots. With the set which comprises further other trough stones, angle stones and closure stones, it is possible to erect a plurality of walls, sound deadening walls or walls serving as windscreens in which panels are fitted and held by the surrounding groove and which may be provided with plants through the utilization of trough stones. If the indenting means are so designed that they mesh with a certain play, curved walls can also be erected. The set is more particularly suitable for a dry construction method.

36 Claims, 40 Drawing Figures

11
12
13
14
15
16
17
18
2
3
5
7
8
9
10
74

CONSTRUCTION UNITS FOR THE ERECTION OF WALLS AND METHOD OF UTILIZATION

BACKGROUND OF THE INVENTION

The present invention relates to a kit or set of construction units for the erection of walls, more particularly for isolated and supporting walls which can be erected in a dry construction process and to the utilization of the set e.g. for erecting a sound deadening wall.

A plurality of sets of constructions units comprising the most different elements are known which may be utilized for the construction of walls, e.g. of isolated walls, sound deadening walls or supporting walls, whereby sets are known permitting the erection of walls by a dry construction method.

It is a feature of the present invention to realize a set of construction units permitting the erection of the most different types of walls, in which the walls can be inclined as well in the horizontal direction as in the vertical direction or be curved, the set comprising also elements permitting placement of vegetation on the wall. Moreover, the set must be produced as economically and rationally as possible and, with respect to the great number of possibilities of applications, it should comprise relatively few elements.

SUMMARY OF THE INVENTION

The features are realized by a construction unit comprising a rectangular base face having a longitudinal axis parallel to a first rectangular dimension, a lateral axis parallel to a second rectangular dimension, and one or more longitudinal ribs oriented parallel to the longitudinal axis and projecting outwardly from the base face. The ribs are adapted for engagement with other units. The units also have lateral faces adjoining the full length of one of each of the opposite ends of the base face that are parallel to the lateral axis, each lateral face having a corresponding trapezoidal profile with two parallel unequal-length base lines. The shorter of each of the base lines joins the ends of the base face, and each longer base line defines one or more longitudinal slots oriented parallel to the longitudinal axis. The slots are adapted for engagement with the ribs of other units for assembly of units into a wall. Furthermore, the units have a circumscribing surrounding groove positioned symmetrically with the longitudinal centerline of the base face and perpendicular to the base lines of the lateral faces.

The units may be combined in a kit of a plurality of units capable of being assembled for the construction of walls.

The invention will be further described by way of practical examples with reference to the accompanying drawings.

DESCRIPTION OF THE PREFERRED EMBODIMENTS

Figure 1:
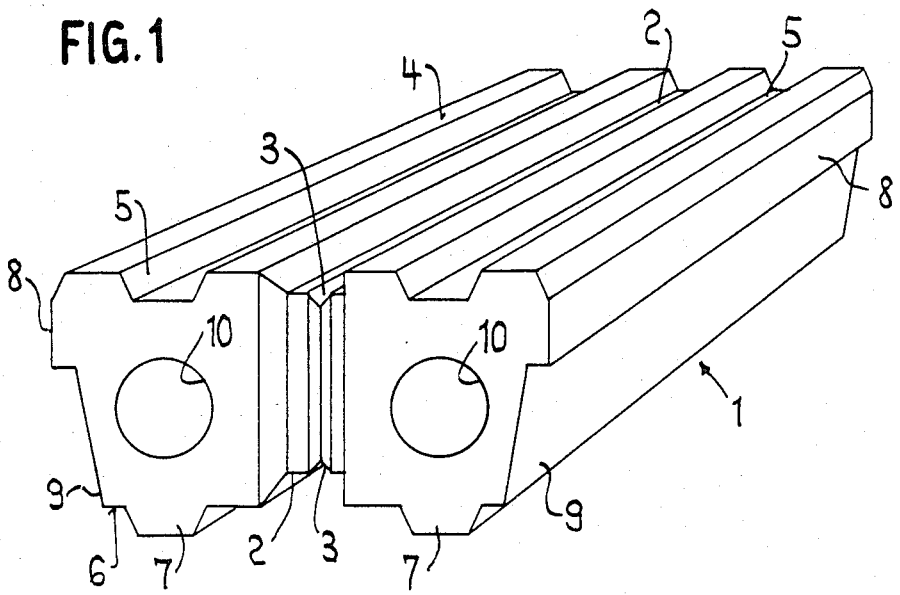
FIGS. 1 and 2 show a perspective view of a standard stone according to the invention.
Figure 2:
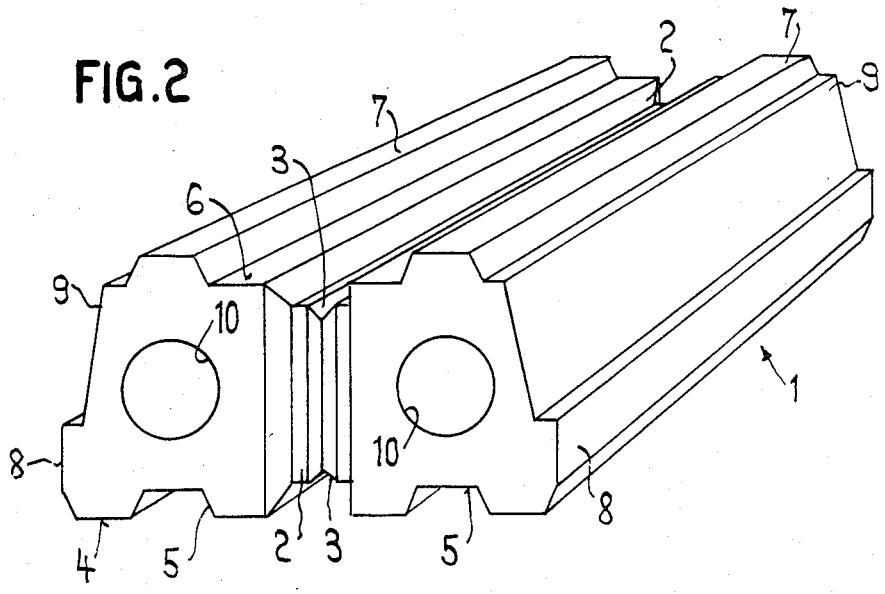
Figures 3, 4:
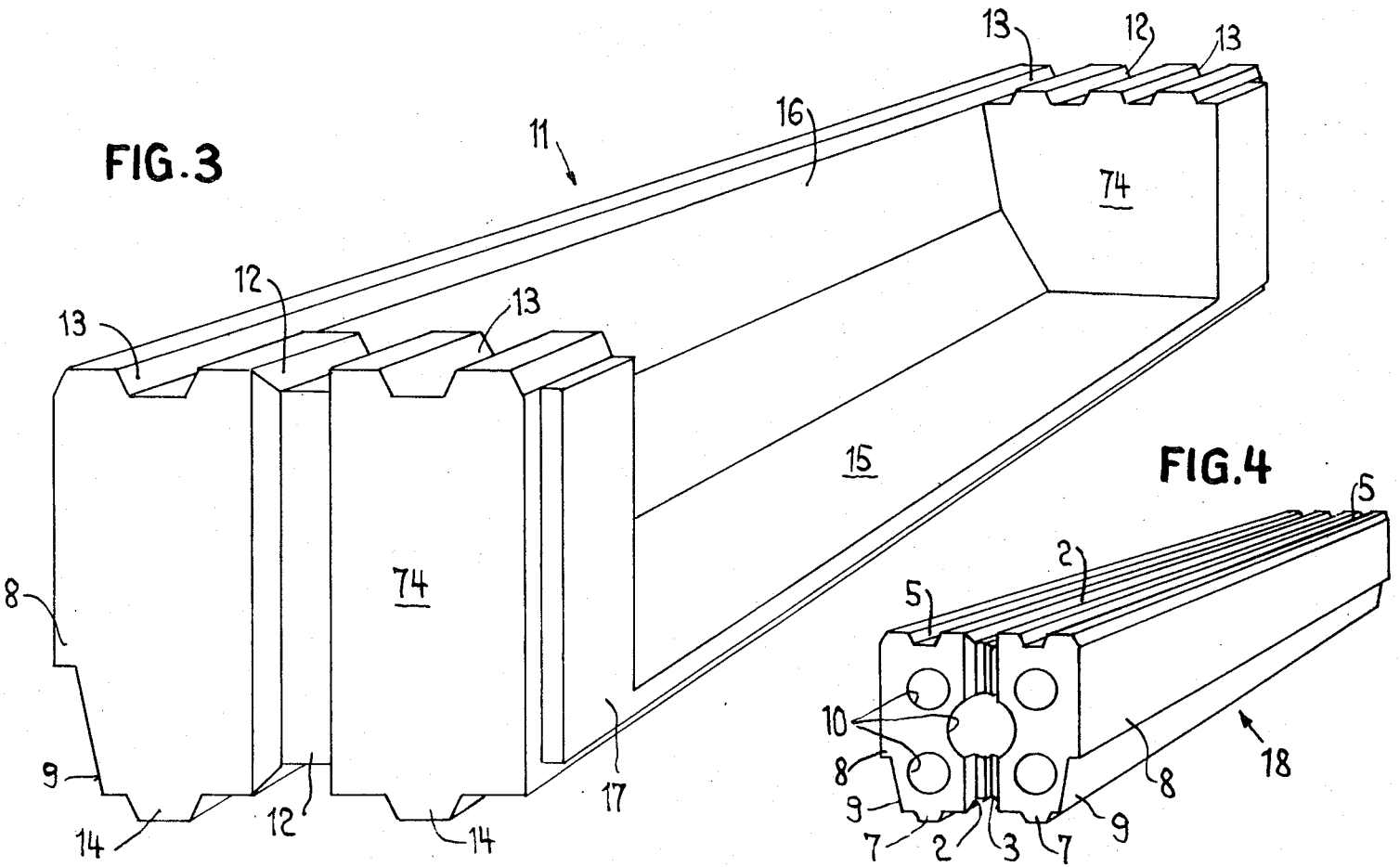
FIG. 3 shows a perspective view of a trough stone.
FIG. 4 shows a perspective view of a long stone.

In FIGS. 1–4 are illustrated three base elements (also called units or stones) of the set: a standard stone in FIGS. 1 and 2, a long stone in FIG. 4 and a trough stone in FIG. 3. The standard stone 1 has a substantially equilateral trapezoidal lateral profile having a base side and comprises a surrounding groove 2 running perpendicularly to the center of the two base lines and comprising also a surrounding bead 3. The signification of the surrounding groove will be apparent in the further examples of applications while the bead serves on the one hand to permit the separation by a stroke of a standard stone into two split stones and on the other hand in the case of the ulilization of such stones for the reinforcement of slopes, to divert the rain and leakage water. Two longitudinal slots 5 symetrically arranged on either side of the surrounding groove 2 are provided on the top face or side 4 having the broader (or longer) base line, as indicated at the top of FIG. 1. Two longitudinal ribs 7 are provided on the side 6 having the smaller (or shorter) base line, opposite the longitudinal slots 5, the width of the trapezoidal ribs being slightly smaller than the width of the corresponding slots. The two flanges or grip edges 8 at the side of the broader base line project out from the two leg sides 9 of the stone. These grip edges render easier the lifting and the displacement of the stones and they serve also as finger protection. Two through holes are provided in the longitudinal direction of the stone, for the purpose of reducing the weight of the stone and to render possible the connection with other stones e.g. by filling up with concrete or cement or by the introduction of rods or wires or similar elements. However, the through holes may also not be provided.

Figure 12:
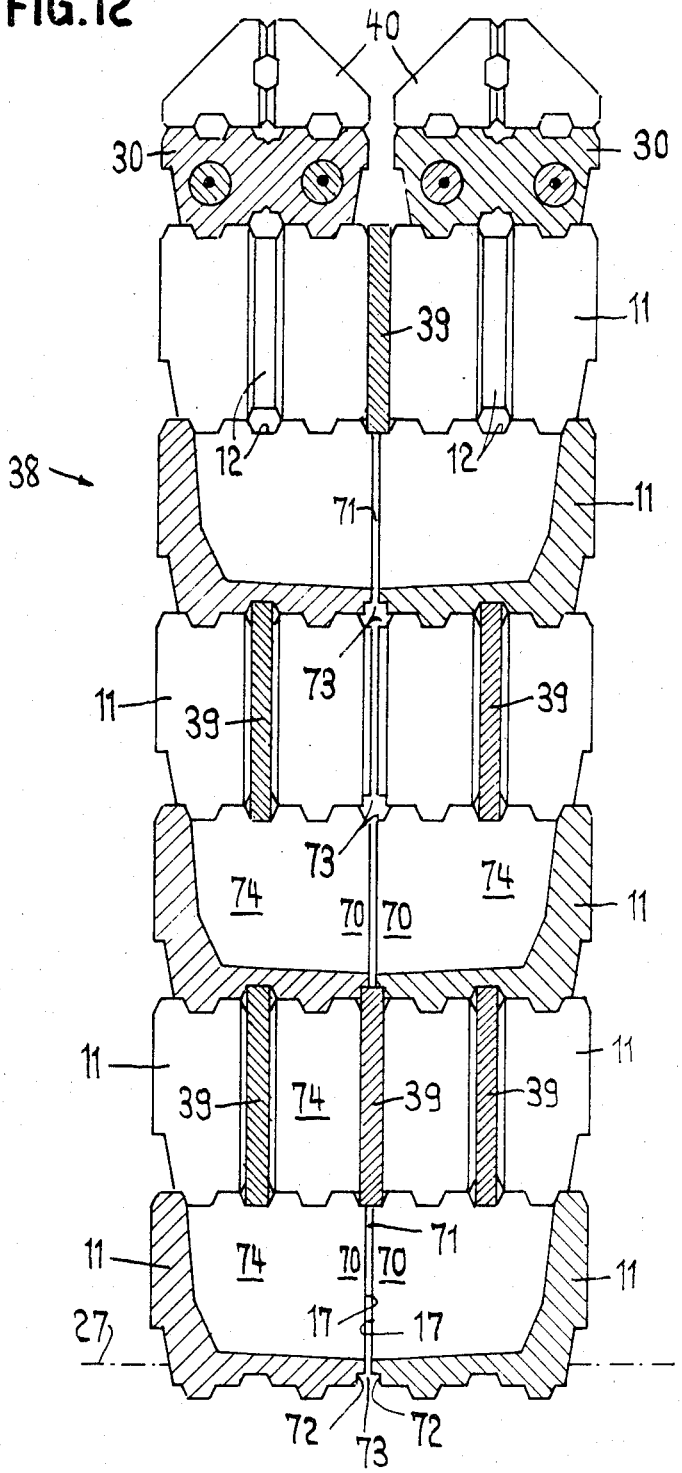
FIG. 12 shows a section of a sound deadening wall.

The trough stone 11 of FIG. 3 has also a substantially trapezoidal lateral profile like the standard stone 1 and also a surrounding groove 12 and the two longitudinal slots 13 and the longitudinal ribs 14. In accordance with its name, the stone defines a hollow cavity along the top face and one of the longitudinal faces and comprises a rectangular base face 15, a longitudinal face or wall 16 and two lateral faces or walls 74. This trough stone is about three times as long as the standard stone and twice as high. At the open side or longitudinal face a shoulder 17 is provided which when two trough stones are assembled produces a determined distance between them for permitting the insertion of plates or similar elements as indicated in the description of FIG. 12.

The long stone of FIG. 4 has the same length and the same height as the trough stone 11. The surrounding groove 2 with the surrounding bead 3, the two longitudinal slots 5 and the two londitudinal ribs 7 are the same as the ones of the standard stone. This long stone has in the present embodiment five holes 10 which may also not be provided, more particularly when light construction materials are utilized.

Figure 5:
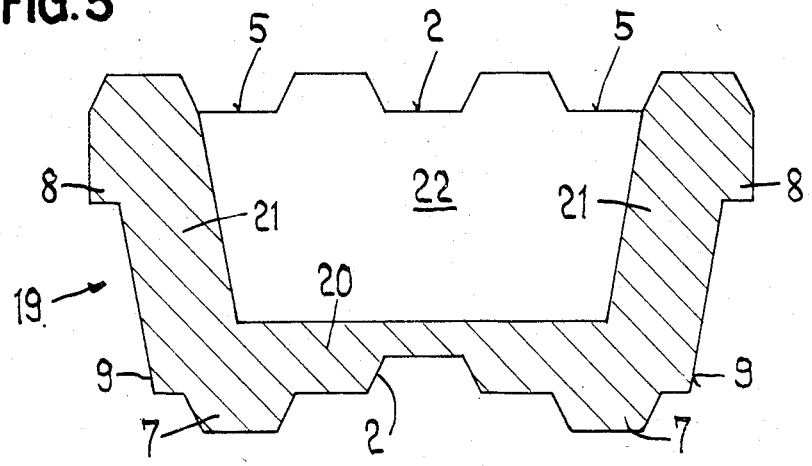
FIGS. 5 and 6 show sections of other embodiments of trough stones.
Figure 6:
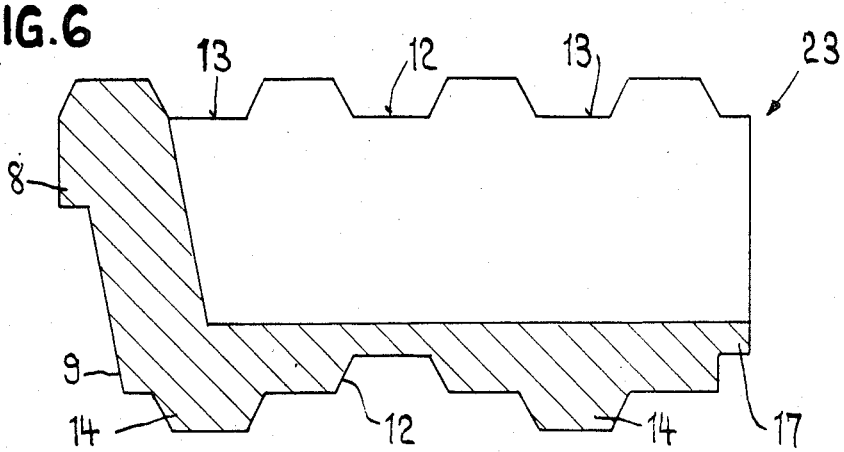

In FIGS. 5 and 6 show two further practical examples of trough stones having both the same height and about three times the length of the standard stone. FIG. 5 shows the closed trough stone 19 with the base 20, the longitudinal walls 21 and the lateral walls 22. This trough stone has the same section as the standard stone and it comprises the same surrounding groove 2 and the longitudinal slots 5 as well as the longitudinal ribs 7. The surrounding groove 2 may also comprise a bead 3. FIG. 6 shows a trough stone 23 similar to the one of FIG. 3 but with the difference that its height corresponds to the one of the standard stone. This stone comprises also the longitudinal groove 12, the longitudinal slots 13 and the longitudinal ribs 14 as well as the shoulder 17. Both stones comprise at the longitudinal walls the same flanges or grip edges 8 as the normal stone.

Examples of the dimensions of the stones are:

STANDARD STONE (FIG. 1)

Length: 36 cm
Width above: 36 cm
Width below: 29.4 cm
Height (total): 18.3 cm

LONG STONE

Figure 7:
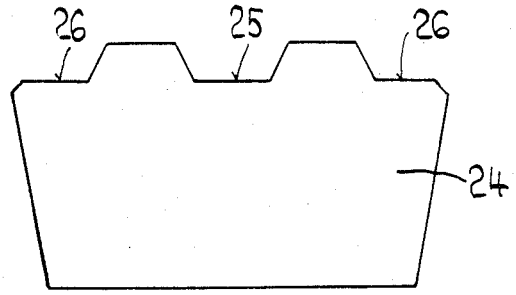
FIG. 7 shows a supporting stone.

Length: 100 cm
Width above: 36 cm
Width below: 29.4 cm
Height: 35.3 cm
Trough stone: like long stone In FIG. 7 shows a supporting stone 24 which may be inserted into the trough stones 19 and 23 and having e.g. a length of one third of the one of the standard stone. The top side of the supporting stone corresponds to the lateral walls of the trough stones 19, 23 and comprises the groove 25 corresponding to the surrounding groove 12 as well as the shoulders 26 corresponding to the longitudinal slots 5, 13. The function of the supporting stone is best understood from FIG. 18 which will be described later. The supporting stone 24 may be fabricated either as an individual stone or in one-piece in the trough stones 19 or 23. It is clear that the supporting stone 24 can also be utilized as a single stone in the trough stone 11.

Figure 8:
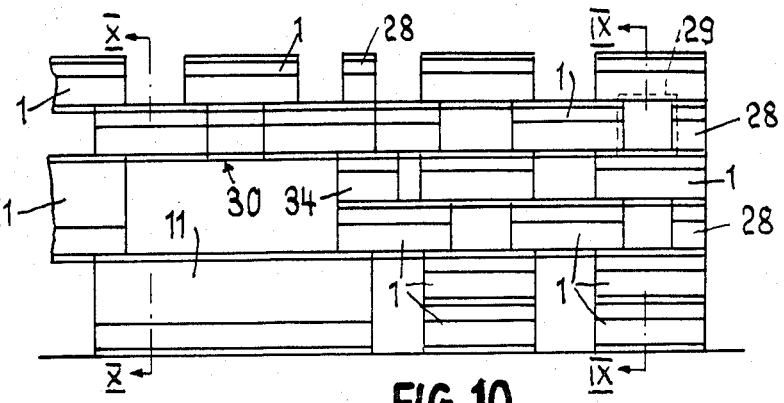
FIG. 8 shows a view of a wall.
Figure 9:
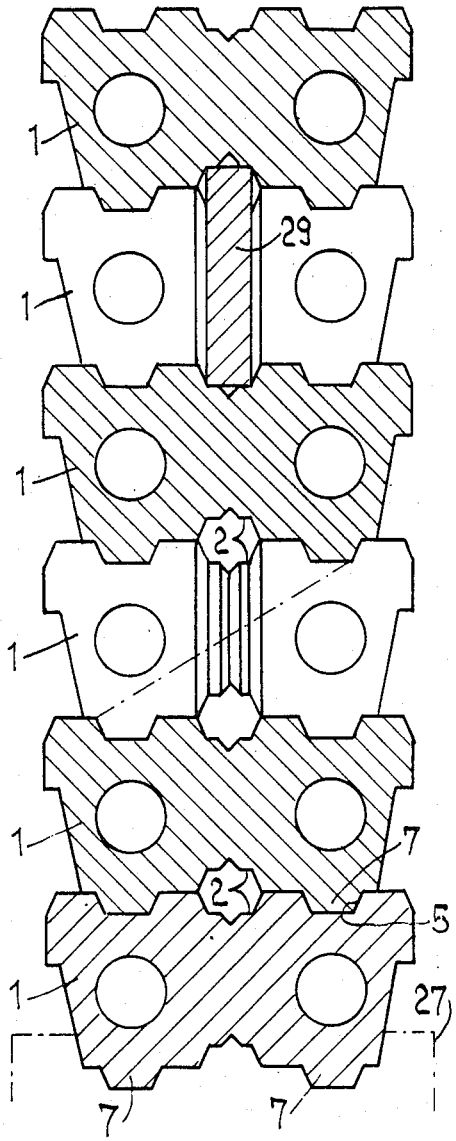
FIG. 9 shows a section along the line IX—IX of FIG. 8.
Figure 10:
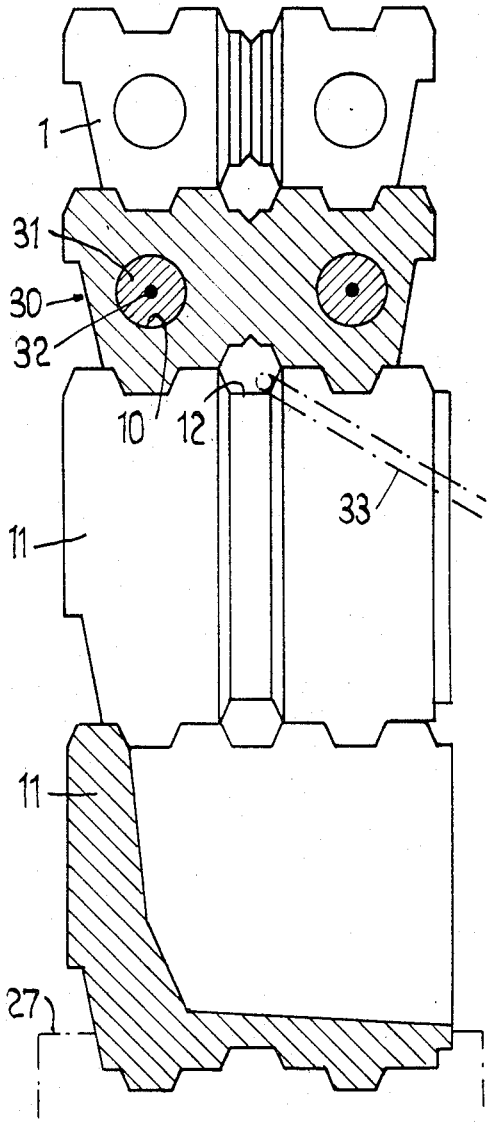
FIG. 10 shows a section along the line X—X of FIG. 8.

In FIGS. 8 to 10 shows a first embodiment of a supporting wall. As indicated in the section of FIG. 9, a standard stone lies on a basement 27, the longitudinal ribs 7 producing a good anchorage of the element. On the standard stone lies a second standard stone, the longitudinal ribs 7 of it fitting into the longitudinal slots 5 of the first stone. On the second stone lies a $\frac{1}{3}$ stone 28, the length of it being one third of the one of the standard stone, as well as a further standard stone in a distance from the previous stone. One recognizes further the gradient of the slope indicated in a broken line. A further standard stone lies over the $\frac{1}{3}$ stone and the standard stone and again a further $\frac{1}{3}$ stone 28 and a standard stone at a determined distance above the preceding. In this example, the interspace between the $\frac{1}{3}$ stone and the standard stone is filled by a panel 29 the thickness of which corresponding to the surrounding groove 2. One recognizes that this panel 29 is held at its four sides. A standard stone is again provided thereon. In the section of FIG. 10 one recognize a trough stone 11 which is anchored in the basement 27 and a further trough stone is placed thereon, on the top of which a lintel 30 is supported which in the present case consists of two standard stones and a $\frac{1}{3}$ stone which are held together by reinforced concrete 31 filled into its two holes 10. The reinforcements 32 may also be prestressed. It is further to be seen that the upper trough stone may be anchored by means of a land tie 33 inserted in the surrounding groove 12. A further standard stone lies on the top of the lintel. One recognizes further in FIG. 8 a half-stone 34. This supporting wall can be erected by a dry construction method as well as by another construction method when required, the stones being held together either by an adhesive substance or by cement. This embodiment shows the multiple possible alternatives, wherein the great trough stones can e.g. be replaced by standard trough stones having a standard height or wherein the two under layers of standard stones may be replaced by long stones with double height. Moreover, all or an arbitrary number of the breaches may comprise panels which may be choosen freely with respect to their colour or their structure. For the upper closure it is also possible to utlize closure stones like the ones of FIGS. 27 to 30.

Figure 11:
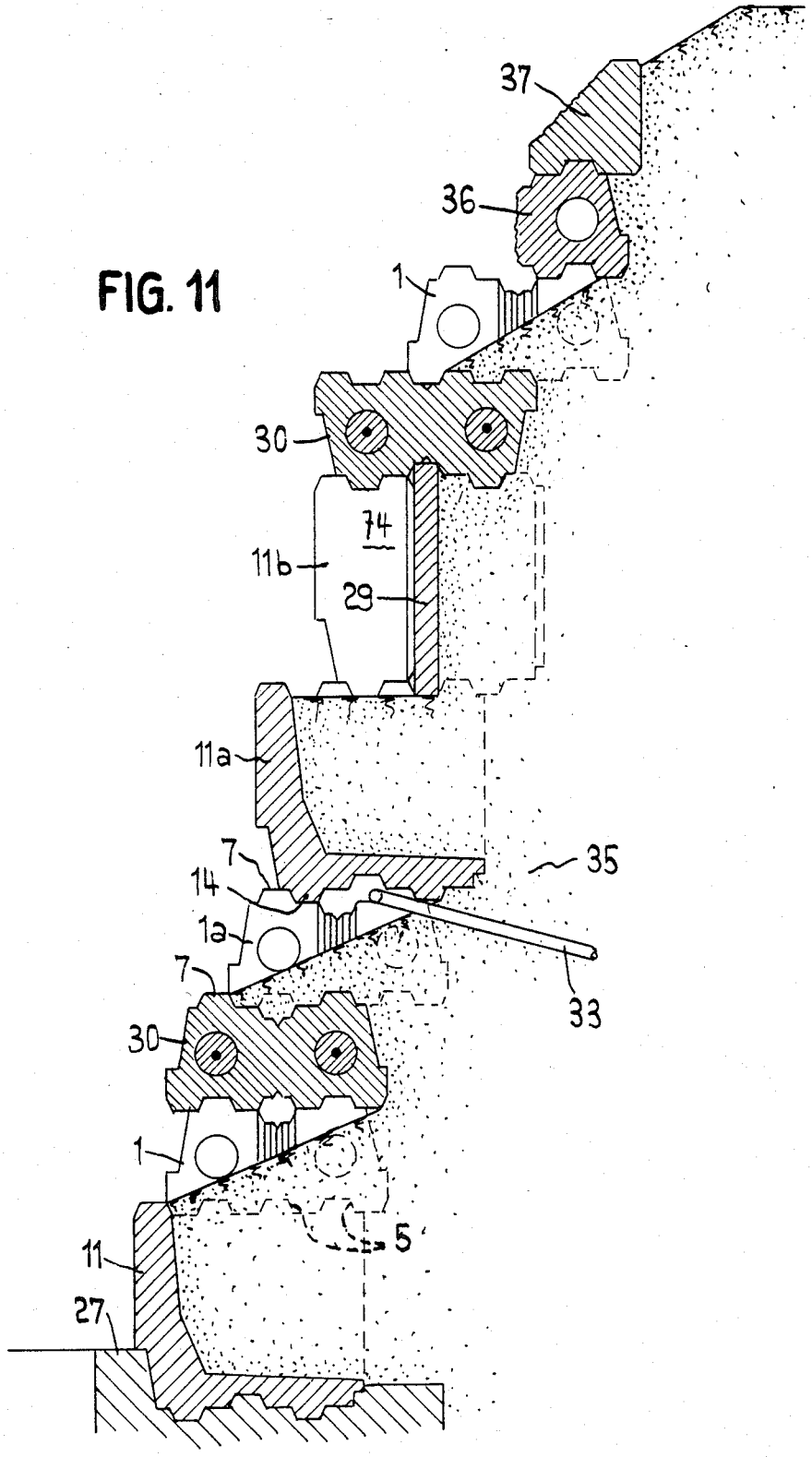
FIG. 11 shows a section of a supporting wall.

While the wall according to FIGS. 8 to 10 is vertical, FIG. 11 shows that the set of construction units is best suited for adapting the supporting wall to the ground, this adaptation being in the present case achieved in the vertical direction. One recognizes again, seen from below, a trough stone 11 anchored in the basement 27, upon which lies offset a standard stone 1. However, in contradiction with respect to the previous embodiment, this standard stone lies reversed with the broad side 4 upon the trough stone and one recognizes that the paths of the ribs provided by the longitudinal slots 5 have the same dimensions and that they fit into these slots 5. In the present case, a lintel 30 consisting of many standard stones 1 held together by reinforced concrete lies displaced on the reverse and offset back lying stone and thereon lies offset a normal stone 1*a*. This normal stone 1*a* is offset in the depth also by a rib path 7. Even in the case of an offset by a rib, respectively of a groove, the indentation of the stones fits well. This layer of standard stones is anchored into the ground 35 by land ties 33. On the top of this standard stone 1 is provided again e.g. a trough stone 11*a* from which it results that also the distances between the ribs 7 and 14 are so dimensioned that the stones mesh in the case in which both rib sides abut against each other. Further, trough stones 11*b* offset by two rib paths lie on top of the trough stone 11*a*. A panel 29 is inserted into the surrounding longitudinal slots 12 of the lateral walls 74 of the adjoining trough stone 11*b*, that is over the trough stone 11*a*. A lintel 30, consisting of standard stones and/or half-stones or either ⅓ stones is provided thereon. Instead, a trough stone according to FIG. 5 filled with earth and provided with plants could be utilized. A standard stone, offset in the depth, lies thereon and on the top of this standard stone lies a splitted standard stone 36 which has been splitted by an action on the surrounding bead 3. Uppermost are provided continuously half closure stones 37 which will be discussed later. It results from this example that the indentation consisting of the surrounding grooves, the longitudinal slots and the longitudinal ribs mesh independently from the indenting means which are meshing. This shows that the single stones are interchangeable, which results in multiple possible alternatives and adaptability. The visible earth may be provided with plants and the sink of rain or leakage water is ensured FIG. 12 shows an embodiment of a sound deadening wall provided with plants in which for the sake of simplification the earth is not represented. In this embodiment, the sound deadening wall 38 consists up to the upper rim of trough stones 11 according to FIG. 3. However, it is clear that instead of these trough stones also long stones according to FIG. 4 or other stones could be utilized here and there, due to the fact that all of these stones are compatible between themselves. Quite at the bottom are provided two trough stones 11 with their longitudinal sides 70 against each other and anchored into the basement 27. These stones form a trough which is filled with plantable earth. The two shoulders 17 of these trough stones do not come into contact, leaving an open joint between themselves. This joint permits on the one hand the flow of rain water and on the other hand the two neighbouring shoulders 72 form an additional surrounding groove 73. The second layer of trough stones 11 from the bottom, which are arranged relatively to each other like in the first layer, is so offset in the longitudinal direction with respect to the lowest layer, that each of the two lateral supporting walls 74 supports over the half thickness. The third layer of trough stones is again perpendicularly disposed over the lowest layer. Sound deadening panels 39 are inserted into the grooves 12, and 73 produced by four trough stones 11 in contact with each other. As indicated in FIG. 12, it is possible to provide one, two or three of such panels per trough. This construction can be repeated up to the adequate height of the sound deadening wall and as indicated in FIG. 12, it can be terminated by two lintels 30 on the top of which closure stones 40 are fixed. After the erection of the wall the troughs can be filled with earth and provided with plants. For the top it could also be utilized e.g. a row of lintels for holding the two parts of the wall together or a row of smaller troughs stones according to FIG. 5 or either a row of closure stones.

Figure 13:
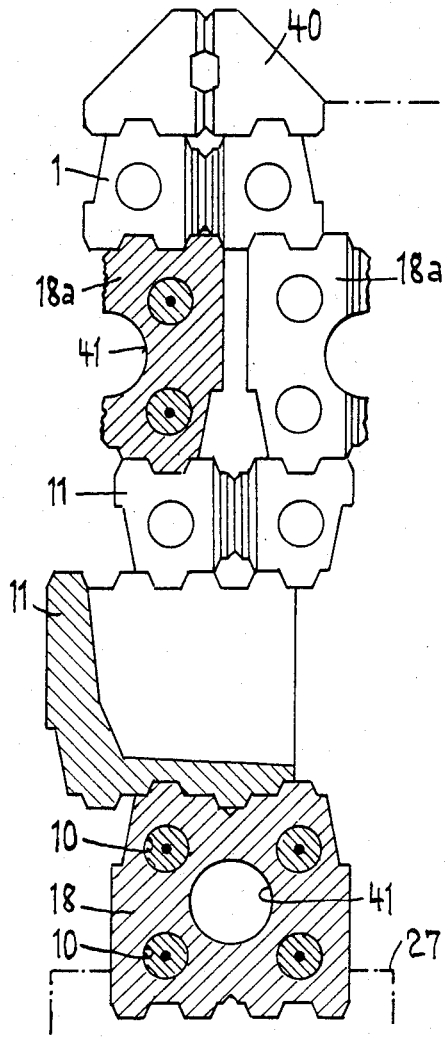
FIG. 13 shows a section of another supporting wall.

FIG. 13 shows a section of a further embodiment of a supporting wall in which the basement comprises long stones 18 which are held together by reinforced concrete introduced in four holes 10, the center hole 41 being free in this example which shows another variant of the ingenuity of the set according to the invention, whereby the long stone 18*a* has been splitted at the surrounding bead and the sides with the center hole 41 have been turned toward the outside.

Figure 15:
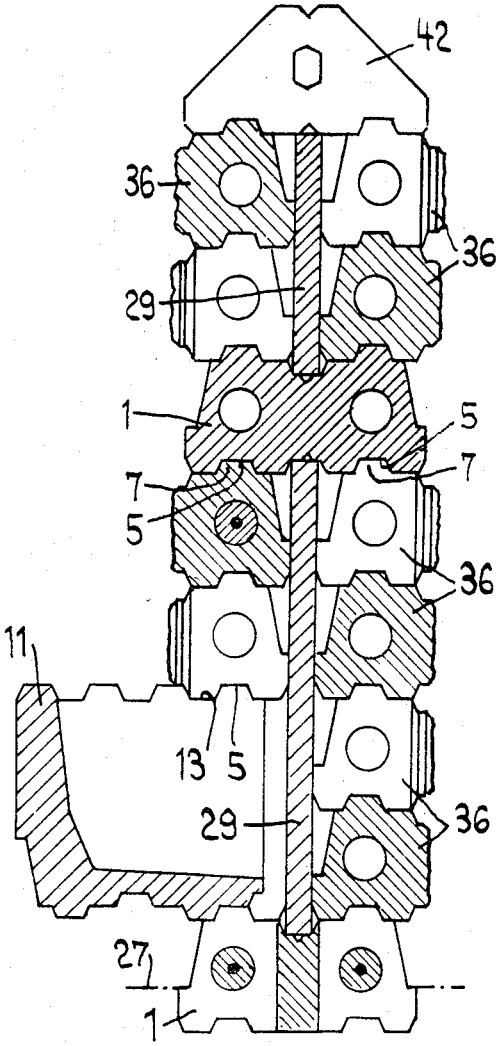
FIG. 15 shows a section along the line XV—XV of FIG. 14.
Figure 14:
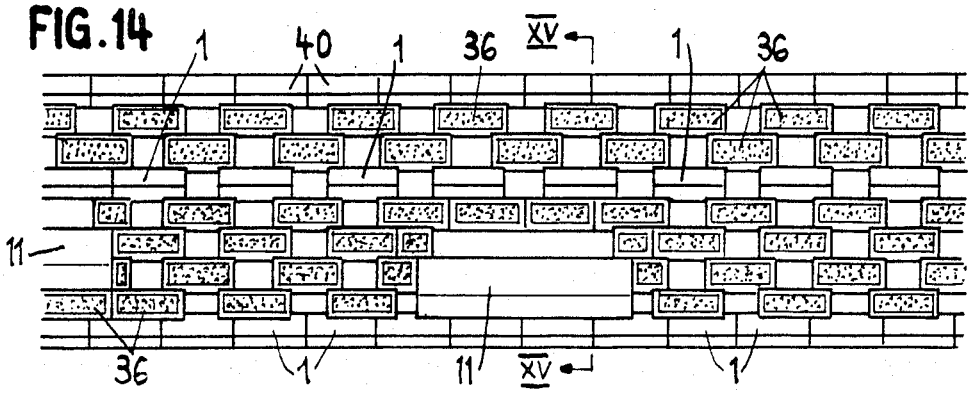
FIG. 14 shows a view of a garden wall.

FIGS. 14 and 15 show the utilization of the set of construction units for the erection of a garden wall with planted trough stones. On a row of standard stones 1 joined together and anchored into the basement are disposed on one side stacked splitted standard stones 36 and on the other side a trough stone 11 is suspended, which fits with its most external longitudinal slot 13 and its adjoining rib path into the longitudinal slot 5 of the standard stone 36. In order to stiffen the wall a row of standard stones 1 is provided whereby each longitudinal rib 7 of a splitted standard stone 36 engages into a corresponding longitudinal slot 5 of the standard stone 1. By this construction, as indicated in FIG. 15, interspaces are created between the half-stones 36, whereby these interspaces may be closed by panels 29. At the top, closure stones 42 may terminate the wall. The utilization of splitted stones 36 having their surfaces of rupture turned toward the outside gives rise to a new fashion element which may be reinforced by the choice of the structure and of the colour of the panels.

Figure 16:
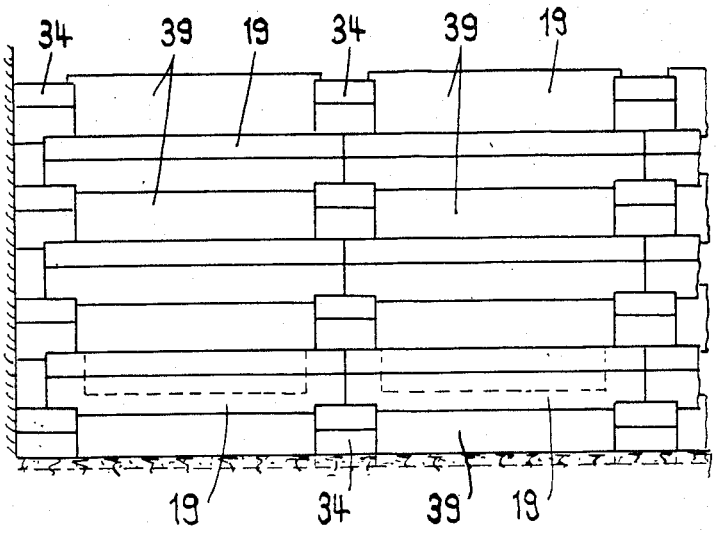
FIG. 16 shows a view of another sound deadening wall.

FIG. 16 shows another example of a sound deadening wall using trough stones 19 according to FIG. 5, having the same height and about three times the length of the standard stones. These trough stones repose on half-stones 34, the lowest row of which is anchored into the basement. A sound deadening panel 39 may be inserted into the groove 2 of the trough stones 19. After the erection of the wall, the individual trough stones may be filled and provided with plants.

Figure 17:
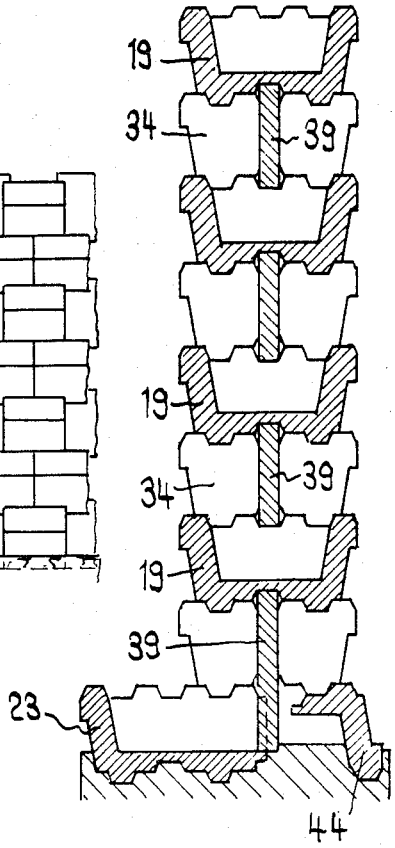
FIG. 17 shows a section of another wall.

FIG. 17 shows a section of a garden wall consisting of trough stones 19 of FIG. 5 and of half-stones 34. It is required to provide e.g. a bed by means of the lowest row of trough stones 23 and to support thereon the above lying rows with splitted trough stones 44. These splitted trough stones 44 are produced as already explained by a mechanical action exerted on the bead 3. It is also possible to replaced the half-stones 34 by normal stones. The trough stones may then be filled with earth and provided with plants.

Figure 18:
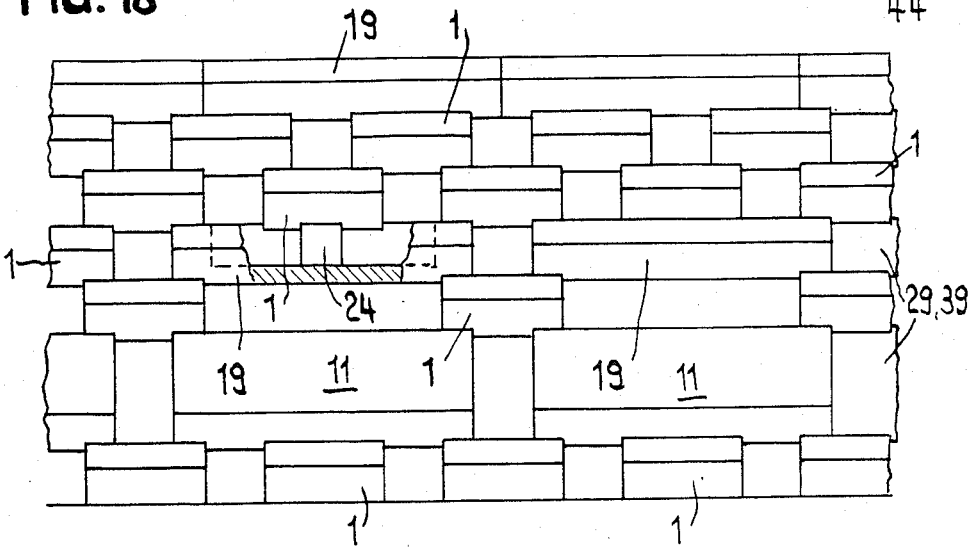
FIG. 18 shows a view of another supporting wall.

FIG. 18 shows a view of a further supporting wall comprising the most different elements, whereby the supporting stones 24 which support the above lying rows of standard stones are more particularly to be considered. One recognizes in this wall standard stones, great trough stones, small trough stones, panels 29 or sound deadening panels 39 and at the top a closure with the trough stones 19, whereby this closure may be fully provided with plants.

Figure 19:
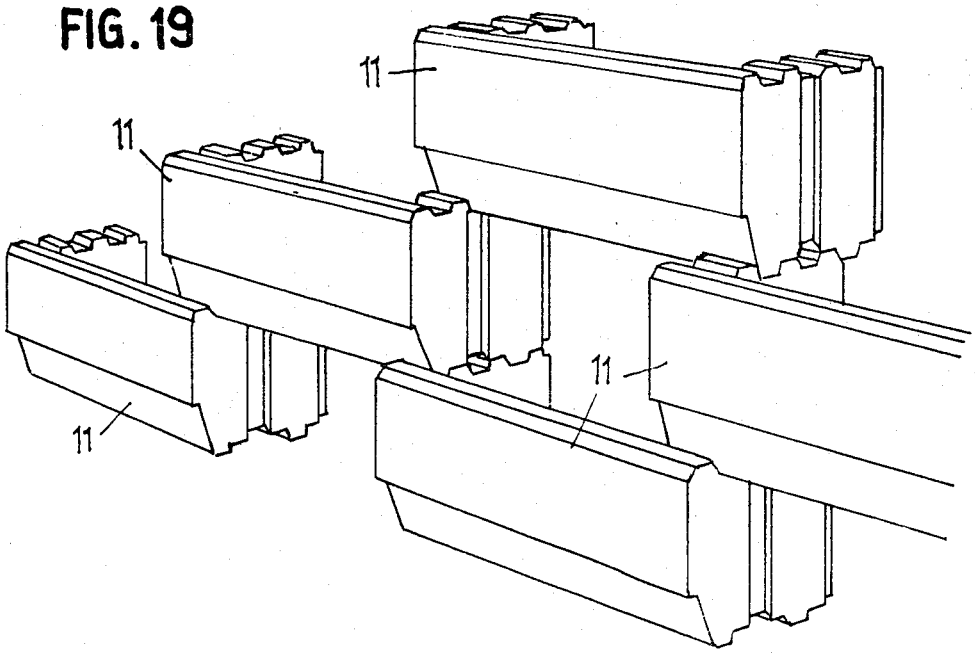
FIG. 19 shows a spatial view of another supporting wall.

The example of FIG. 19 shows that a wall may be erected, comprising only trough stones 11.

Figure 20:
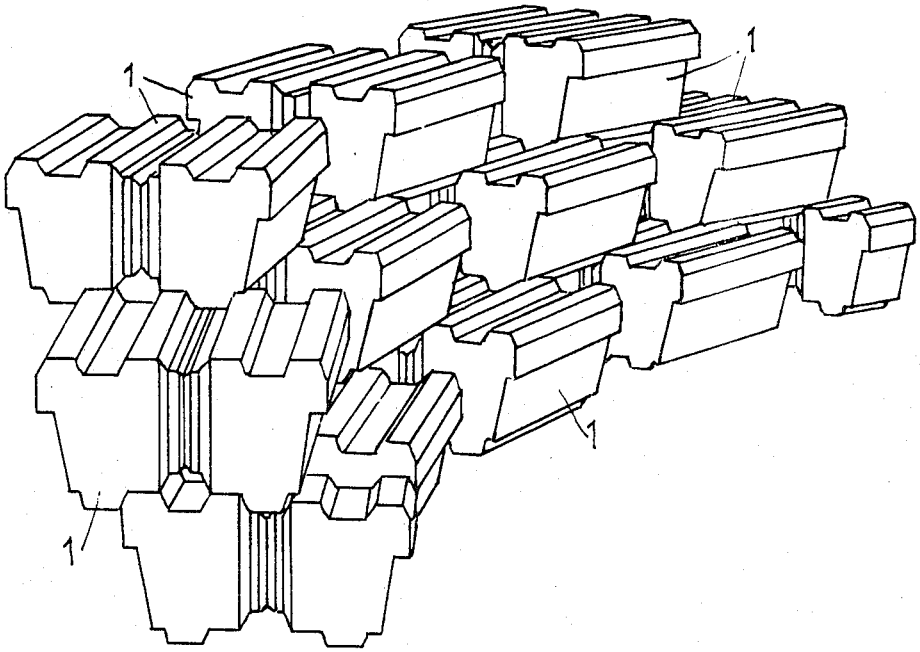
FIG. 20 shows a spatial view of a curved wall.

As mentioned at the beginning, the indenting elements at the base line surfaces of the stones are so dimensioned that the stones can always be stacked with a certain play. This permits to erect a curved wall utilizing these stones as indicated in FIG. 20 which gives the possibility to follow certain curves of the ground. One recognize in FIG. 20 standard stones which in this example are not provided with holes as well as a half and a ⅓ stone. It is clear that the smallest radius of curvature depends on the play of the indentations and on the overlaps.

Figure 21:
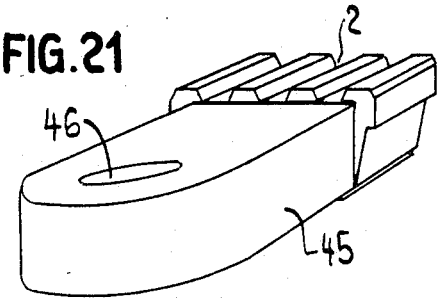
FIGS. 21–23 show a perspective view of a corner stone.
Figure 22:
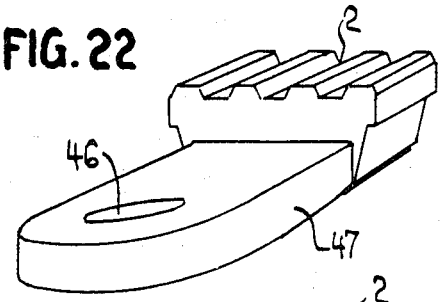
Figure 23:
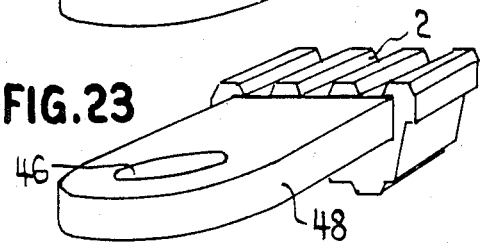
Figure 23:
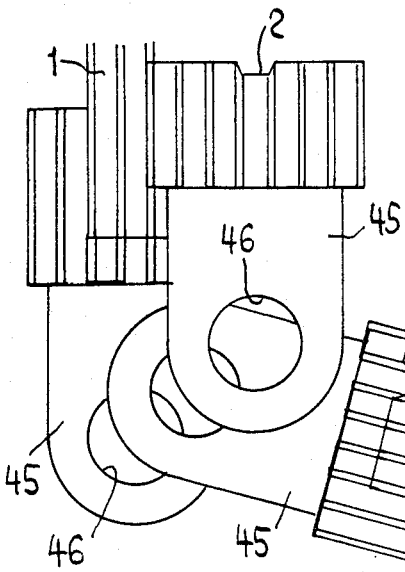
Figure 24:
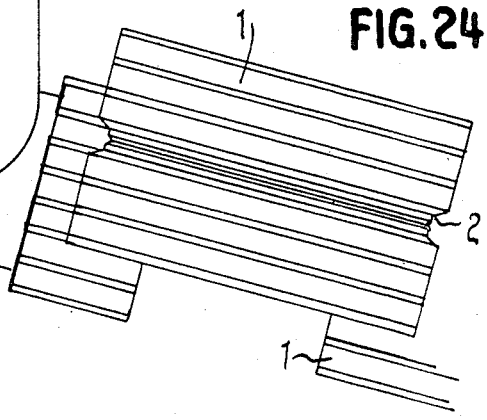
FIG. 24 shows a top view of a corner.
Figure 25:
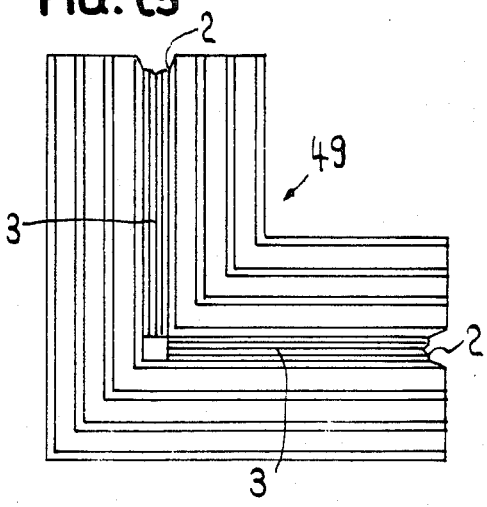
FIGS. 25 and 26 show a top view of two other corner stones.
Figure 26:
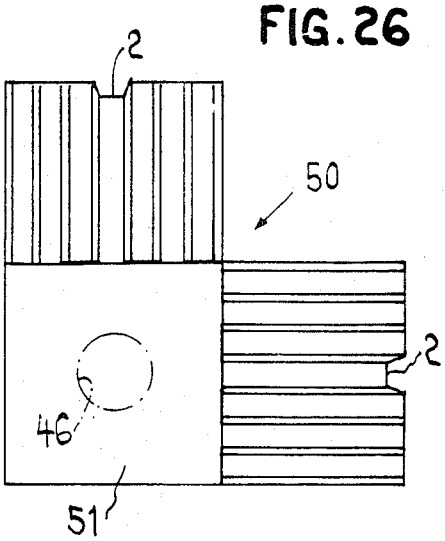

When corners and angles are required, the present play between the individual indenting elements is not great enough so that particular corner stones like the ones shown in FIGS. 21 to 26 must be utilized. FIG. 21 shows a first embodiment of a corner stone 45 having the same dimensions as the standard stone and over about ¼ of its length the same indenting elements like the center groove corresponding to the center groove 2, two longitudinal slots and on the other side two longitudinal ribs. This corner stone is rounded on the other side and comprises a hole 46. This stone permits to cover a great angular domain. FIGS. 22 and 23 show two angle stones 47 and 48 symetrical with respect to each other, whereby the part free of indentation is only half as high as the other part with indentation. These angle stones are also rounded at their part without indentation and they are provided with the same hole 46. FIG. 24 shows that by means of these angle stones not only almost any arbitrary angle may be provided in the horizontal direction but also a slope of the corner in the vertical direction by an offset stacking of the elements. One recognizes further from FIG. 24 that between each two angle stones having the same direction another stone must be inserted. The holes 46 serve for being filled with concrete or for inserting a rod or a similar element.

It is also possible to utilize angle stones which are fabricated in one piece and having a fixed angle e.g. of 90° instead of the angle stones, which may form an arbitrary angle, but where two such stones are required for obtaining this angle. The angle stone 49 according to FIG. 25 comprises the same indenting elements as the standard stone and also a bead 3 along the center groove 2 and it may also be splitted. It is clear that the thickness of the stone is adapted to the other stones. The corner stone 50 according to FIG. 26 comprises the indentations 2, 2 and 7 only at the extremities of both legs, the corner 51 being flat. As the case may be, this flat corner may comprise the same hole 46 as the first described corner stone. It is of course also possible to produce corner stones having an angle different from 90°.

Figure 27:
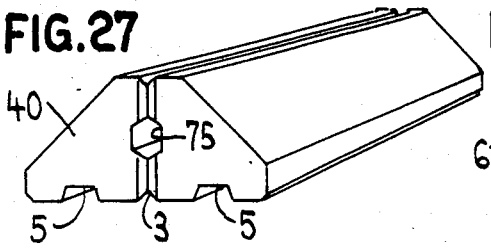
FIG. 27 shows a perspective view of a closure stone.
Figure 28:
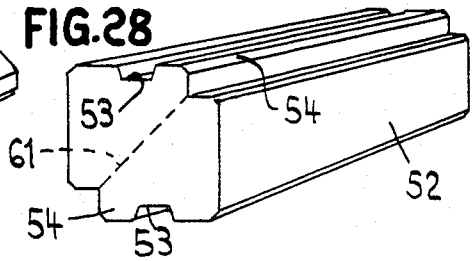
FIG. 28 shows a perspective view of another closure stone.
Figure 29:
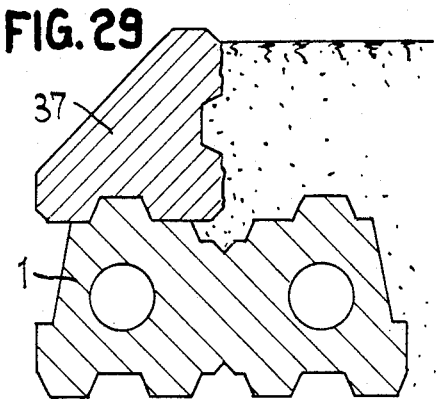
FIGS. 29–33 show sections of various applications of the closure stones.
Figure 30:
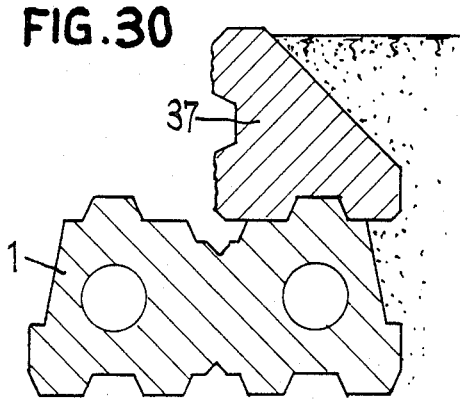

FIGS. 27 and 28 show two closure stones which can be utilized in multiple ways and also as half stones, if beads are provided. FIG. 27 shows the closure stone 40 which was utilized in FIG. 12. This stone has a triangular section with flattened top and comprises the same surrounding bead 3 as the standard stone and at its base the two longitudinal slots 5 arranged in the same distance. A through hole 75 is provided in the median line of this border stone, the section of this hole corresponding to two longitudinal slots, as indicated in FIGS. 29 and 30, in such a way that when the stone is splitted along the surrounding bead 3 it comprises a groove 5 at both of its legs surfaces . The closure stone 40 can be utilized as a full stone e.g. like in FIG. 12 or as a half closure stone 37 like in FIG. 11 or in FIGS. 29 and 30. The stone 40 may also comprise at its base a groove 2 in the region of the bead 3.

Figure 31:
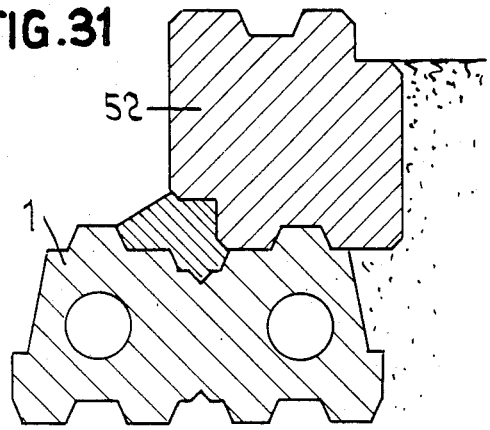
Figure 32:
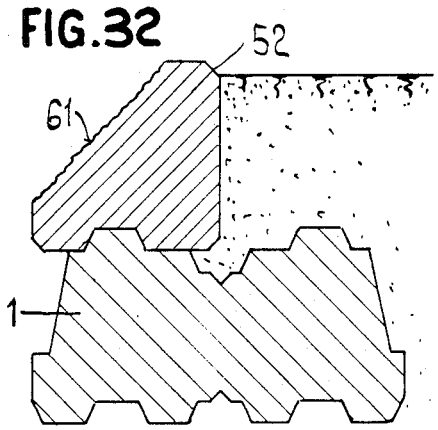
Figure 33:
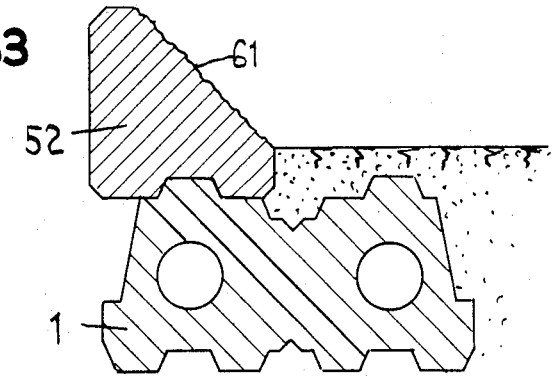

FIG. 28 shows a further closure stone 52 having a substantially square section. This stone comprises a longitudinal slot 53 at two of its opposite sides, these slots being symetrically arranged with respect to one another and an adjoining longitudinal rib 54, the dimensions of which corresponding to the ones of the other longitudinal slots and longitudinal ribs. FIG. 31 shows a practical example of the utilization of this closure stone, whereby the stone may be fixed on the underlying stones by means of cement or similar materials. It is possible to split this stone longitudinally along the line 61, which produces a half closure stone according to FIGS. 32 and 33. In FIG. 33 the closure stone 52 is fixed with cement or similar materials to the underlying stones. One recognizes that the edges of the fracture serve as ornamental elements.

Figure 34:
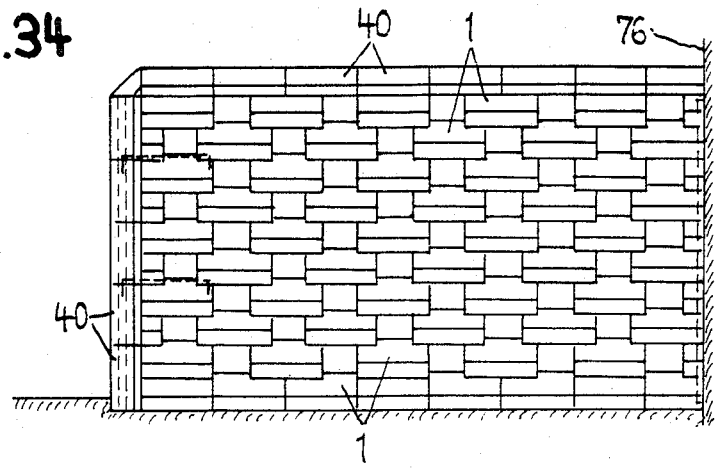
FIG. 34 shows a view of a windscreen wall.
Figure 35:
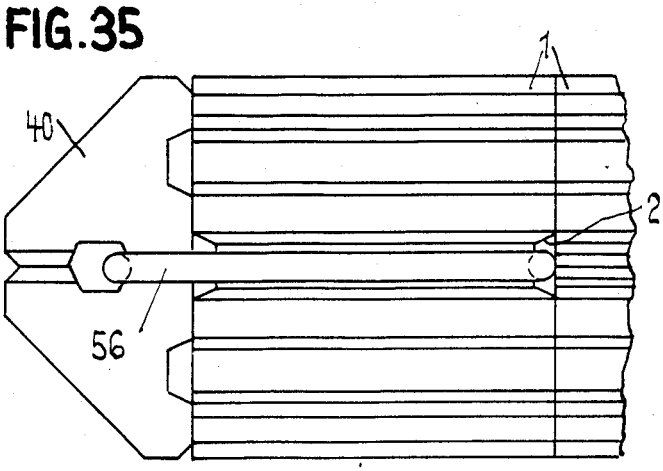
FIGS. 35 and 36 show details of FIG. 34.
Figure 36:
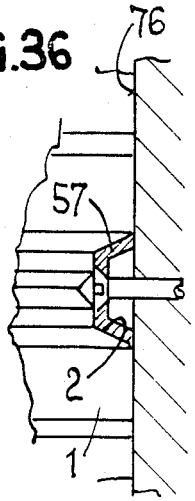

FIG. 34 shows a further wall, e.g. a wall serving as windscreen, which is constructed adjoining the wall of a house 76. The protecting wall can be terminated at the top as well as at the side with closure stones 40, whereby these stones can be anchored in the wall by means of retaining clips 56 as indicated in FIG. 35. FIG. 36 shows another possibility for anchoring the protecting wall to the wall of the house 76, whereby an iron bar 57 is fixed into the wall of the house by means of screws, the outer form of the iron bar being exactly adapted to the surrounding groove 2 of the stones 1.

Figure 37:
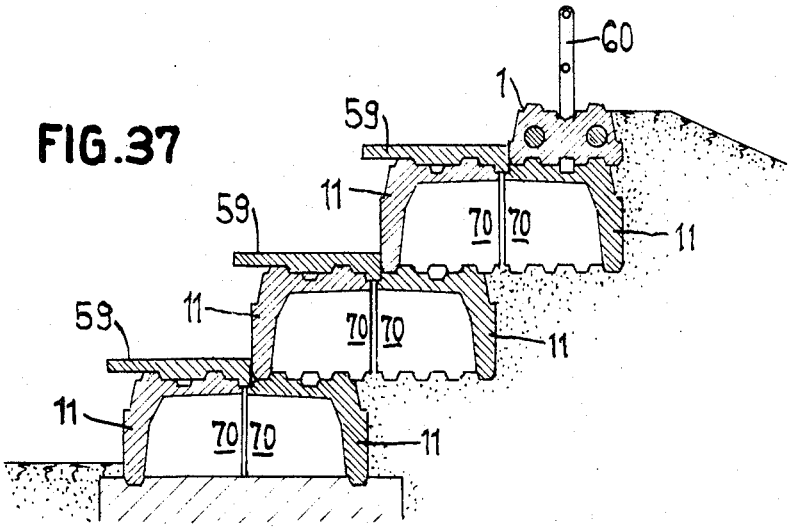
FIG. 37 shows a section of another practical example.

FIG. 37 shows the utilization of trough stones 11 for a seating place in a stadium or a similar construction. One recognizes two reversed trough stones 11 which are disposed with their open sides 70 looking against each other. The stones are stacked with an offset corresponding to the full trough width one upon the other. On these reversed elements are provided removable supports for seats 59 having the corresponding indenting means. As a closure on the top, a lintel of standard stones may be provided, in which a barrier 60 can be mounted.

Figure 38:
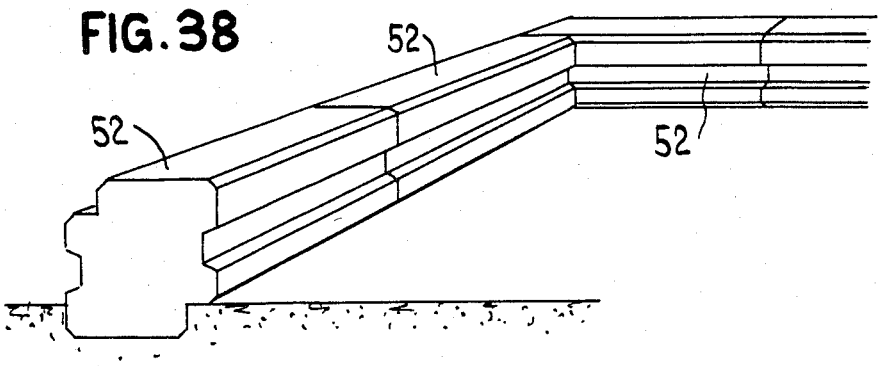
FIGS. 38–40 show other practical examples of closure stones.
Figure 39:
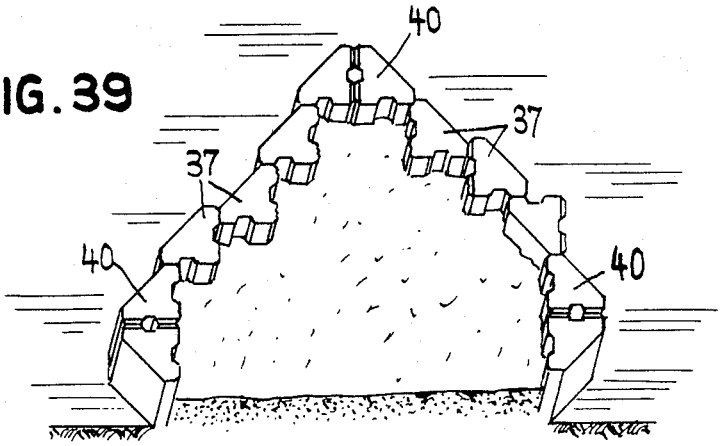
Figure 40:
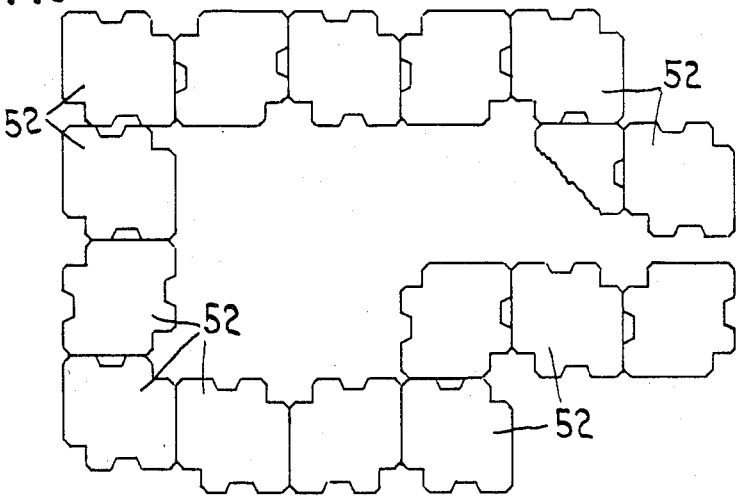

FIGS. 38, 39 and 40 show practical examples of utilization of the closure stones for frames or palisades. In the example of FIG. 38, the closure stones 52 are either anchored directly into the ground or into a basement, these stones being arranged adjoining each other. FIG. 39 shows an arrangement comprising closure stones 40 and 37, these stones having a smaller length than the one of the stones according to FIG. 27 or 29 or 30 and they are disposed with the front side looking to the top. FIG. 40 shows a fence with closure stones 52 which are also shorter than the ones of FIG. 38 and having also their front side looking to the top.

It is also possible in the place of the previous described walls to erect solid walls in which, in the longitudinal direction, the front sides of the stones are bordering each other. Such walls may also be erected vertically or tilted to the rear, respectively with stones offset by rib paths. It is also possible to erect smaller walls comprising only stones capable to be splitted according to FIGS. 1, 18 or 19.

It is further possible to produce the supporting stones 24 according to FIG. 7 of the same full length as the trough stones and to use these stones as closure stones in accordance with FIGS. 27 and 28.

I claim:

1. A kit comprising a plurality of construction units capable of being assembled for the construction of walls, at least some of said units having structural features including:

a rectangular base face having a longitudinal axis parallel to a first rectangular dimension, a lateral axis parallel to a second rectangular dimension, and at least one longitudinal rib oriented parallel to said longitudinal axis and projecting outwardly from said base face, said rib being adapted for engagement with other units;

lateral faces adjoining the full length of one of each of the opposite ends of said base face that are parallel to the lateral axis, each lateral face having a corresponding trapezoidal profile with two parallel unequal-length base lines, a longer base line and a shorter base line, each of said shorter base lines adjoining said ends of said base face, each of said longer base lines defining at least one longitudinal slot oriented parallel to said longitudinal axis, said slot being adapted for engagement with the ribs of other units for assembly of units into a wall;

a circumscribing surrounding trapezoidal central groove defined by said unit and positioned symmetrically with the longitudinal centerline of said base face and perpendicular to said base lines of said lateral faces; and said kit further including a plurality of generally planar panels adapted to be retained in said trapezoidal groove.

2. The kit according to claim 1, further comprising at least one standard stone having said structural features and at least one long stone which is twice as high and approximately three times as long as said standard stone, said long stone having said structural features and having lateral faces each defining a substantially equilateral trapezoidal profile.

3. The kit according to claim 1, further comprising a one-piece fabricated L-shaped angle stone having legs, each leg having said structural features.

4. The kit according to claim 1, further comprising a closure stone having a triangular cross section with a flattened top, a surrounding bead running through said flattened top and said closure stone having a through hole oriented perpendicular to said cross section, said through hole having a hexagonal cross-sectional profile having the dimensions of two of said trapezoidal surrounding grooves in mutually opposed relationship.

5. The kit according to claim 1, wherein said surrounding groove of at least one of said units defines a surrounding bead adapted for separation of said unit into portions along said bead.

6. The kit according to claim 1, wherein at least one of said units defines an open cavity in a top face intersecting said longer base lines.

7. The kit according to claim 6, wherein at least one of said units is a trough stone having said structural features and having opposing longitudinal faces adjoining said lateral faces and said base face: one of said longitudinal faces further having a shoulder projecting outwardly therefrom and defining a cavity in communication with said top face cavity.

8. The kit according to claim 7, further comprising a supporting stone adapted for engagement with said trough stone, said supporting stone having a central groove, and shoulders corresponding to said longitudinal slots.

9. A wall constructed from the kit as recited in claim 7, wherein said wall has a double row of trough stones, pairs of said trough stones having said longitudinal face cavities facing each other and, said pairs being separated from each other by a distance parallel to said longitudinal axis so as to form breaches therebetween, and wherein at least one panel is disposed in said breaches, said panels being secured between said shoulders of said pair of trough stones.

10. A seating area constructed from the kit as recited in claim 7 wherein said seating area comprises a plurality of double rows of trough stones, pairs of said through stones having said longitudinal face cavities facing each other in a row generally oriented along said longitudinal axes thereof with said base faces in a generally upwardly orientation, to form a first layer of pairs and at least one other layer of paired trough stones placed on top of said first layer and laterally offset relative thereto so as to form step-shaped seating surfaces upon each laterally offset successive layer of paired trough stones.

11. The kit according to claim 1 wherein at least one of said units has opposing longitudinal faces adjoining said lateral faces and said base face; said longitudinal faces having longitudinal flanges projecting therefrom proximate said longer base lines for gripping said flanged unit.

12. The kit according to claim 1 wherein at least some of said units define holes therethrough.

13. The kit according to claim 1, further comprising an angle stone having said structural features, one of said lateral faces having a planar portion projecting therefrom said planar portion having a thickness with a rounded distal end and having a hole therethrough.

14. The kit according to claim 13 wherein a first angle stone has a planar portion projecting along said shorter baseline and a second angle stone has a planar portion projecting along said longer baseline.

15. A wall constructed from the kit as recited in any one of claims, 1, 2, 8, 13, or 3, wherein said wall comprises breaches in which said panels are retained in said groove.

16. The angle stone according to claim 3, wherein said surrounding groove defines a surrounding bead for separation of said angle stone into portions along said bead.

17. The angle stone according to claim 3, wherein said legs have a common planar portion projecting from a lateral face of each of said legs.

18. The angle stone according to claim 2, wherein said planar portion has a hole defined therethrough.

19. The wall according to claim 15, wherein said wall comprises trough stones which can receive plants in said cavity.

20. A wall constructed from the kit as recited in claim 4 wherein said closure stones have a longitudinal axis oriented perpendicularly to said triangular cross section and wherein said closure stones are oriented in abutting relationship with each longitudinal axis generally perpendicular to earth terrain upon which said closure stones are placed.

21. The kit according to claim 1, further comprising a square closure stone having a pair of opposite sides each having a longitudinal slot symetrically arranged with respect to each other, said square closure stone further having a shoulder corresponding to one of said longitudinal ribs abutting each of said longitudinal slots.

22. The square closure stone according to claim 21, wherein said square closure stone is cleavable along a diagonal line.

23. A wall constructed from the kit as recited in claim 4 or 21 wherein said closure stones are oriented in abutting relationship so as to form an enclosure.

24. The kit according to claim 1, wherein said longitudinal slots are further adapted for loose engagement with the ribs of another unit for non-parallel alignment of said ribs and slots and thereby non-parallel alignment of units.

25. The unit according to claim 1 wherein said surrounding groove further comprises a surrounding concave bead adapted for separation of said unit into portions along said bead.

26. The unit according to claim 1 wherein at least some of said units define holes therethrough.

27. The unit according to claim 1 wherein said longitudinal slots are further adapted for loose engagement with the ribs of other units in order to allow non-parallel alignment of said ribs and slots and thereby non-parallel alignment of units along their respective longitudinal axes.

28. A method of wall erection by means of the kit of construction units as recited in claim 1 wherein the method comprises:

laying a layer of said units lateral end-to-lateral end in abutting relationship to form a first layer;

laying one or more additional layers of units on top of said first layer, said slots and ribs in each unit engaging the corresponding slots and ribs of units in abutting relationship above and below thereof;

spacing said additional units so as to define voids in said wall at desired intervals by means of void-defining faces of said void-defining units;

filling at least one of said voids with panels having edges adapted for attachment to said void-defining units; and attaching said panels to said void-defining units by engaging the said panel edges in said surrounding grooves existing in the void-defining faces so as to capture said edges in said surrounding grooves.

29. A method of wall erection by means of the kit of construction units as recited in claim 6 wherein the method comprises:

laying a layer of said units lateral end to lateral end in abutting relationship to form a first layer;

laying one or more additional layers of units on top of said first layer, said slots and ribs in each unit engaging the corresponding sots and ribs of units in abutting relationship above and below thereof;

spacing said additional units so as to define voids in said wall at desired intervals by means of void-defining faces of said void-defining units;

filling at least one of said voids with panels having edges adapted for attachment to said void-defining units; and attaching said panels to said void-defining units by engaging the said panel edges in said surrounding grooves existing in the void-defining faces so as to capture said edges in said surrounding grooves.

30. The method as recited in claim 29 further comprising utilizing some of said cavities for retention of plants.

31. A method of wall erection by means of the kit of construction units as recited in claim 7 wherein the method comprises:

laying a layer of said units lateral end to lateral end in abutting relationship to form a first layer;

laying one or more additional layers of units on top of said first layer, said slots and ribs in each unit engaging the corresponding slots and ribs of units in abutting relationship above and below thereof;

spacing said additional units so as to define voids in said wall at desired intervals by means of void-defining faces of said void-defining units;

filling at least one of said voids with panels having edges adapted for attachment to said void-defining units; and attaching said panels to said void-defining units by engaging the said panel edges in said surrounding grooves existing in the void-defining faces so as to capture said edges in said surrounding grooves.

32. The method as recited in claim 31 further comprising utilizing some of said cavities for retention of plants.

33. A construction unit comprising:

a rectangular base face having a longitudinal axis parallel to a first rectangular dimension, a lateral axis parallel to a second rectangular dimension, and at least one longitudinal rib oriented parallel to said longitudinal axis and projecting outwardly from said base face, said rib being adapted for engagement with other units;

lateral faces adjoining the full length of one of each of the opposite ends of said base face that are parallel to the lateral axis, each lateral face having a corresponding trapezoidal profile with two parallel unequal-length base lines, a longer base line and a shorter base line, each of said shorter base lines adjoining said ends of said base face, each of said longer base lines defining at least one longitudinal slot oriented parallel to said longitudinal axis, said slot being adapted for engagement with the ribs of other units for assembly of units into a wall;

a circumscribing surrounding trapezoidal groove defined by said unit and positioned symmetrically with the longitudinal centerline of said base face and perpendicular to said base lines of said lateral faces adapted for retaining an edge of a generally planar panel; and a top face adjoining said lateral faces along said longer base lines, said top face defining an open cavity.

34. The unit according to claim 33 wherein at least one of said units has opposing longitudinal faces adjoining said lateral faces and said base face; one of said longitudinal faces further having a shoulder projecting outwardly therefrom and defining a cavity in communication with said top face cavity.

35. The unit according to claim 34 wherein at least one of said units has opposing longitudinal faces adjoining said lateral faces and said base face; said longitudinal faces having longitudinal flanges projecting therefrom proximate said longer base lines for gripping said unit.

36. A method of wall erection by means of a kit, including cavitied construction units as recited in claim 34 wherein the method comprises:

laying a first row of said units lateral end-to-lateral end in abutting relationship;

positioning a second row of said units next to said first layer in an opposing relationship so that said longitudinal cavity-bearing faces and shoulders are in communication with each other, said opposing shoulders and longitudinal faces thereof defining a gap, said first and second rows being defined as a paired row;

laying one or more additional paired rows on top of each other, said slots and ribs of said units in engaging relationship above and below thereof;

spacing said additional paired rows so as to define voids in said wall at desired intervals by means of void-defining faces of said void-defining units;

filling at least one of said voids with panels having edges adapted for attachment to said void-defining units; and attaching said panels to said void defining units by engaging said panel edges in said gaps defined by said units.

* * * * *